United States Patent [19]

De Block et al.

[11] Patent Number: 4,989,381

[45] Date of Patent: Feb. 5, 1991

[54] VENTILATED DOOR LIGHT

[75] Inventors: David A. De Block; Kert E. Artwick, both of Holland, Mich.

[73] Assignee: ODL, Incorporated, Zeeland, Mich.

[21] Appl. No.: 849,966

[22] Filed: Apr. 10, 1986

[51] Int. Cl.[5] ..... E06B 1/36; E06B 3/24

[52] U.S. Cl. ..... 52/204; 52/656; 49/504

[58] Field of Search ..... 52/304, 656, 204; 49/501, 504, 171; 160/106, 89

[56] References Cited

U.S. PATENT DOCUMENTS

| | | | |
|---|---|---|---|
| 309,633 | 12/1884 | Lee | 160/106 |
| 2,705,415 | 4/1955 | Livesay . | |
| 2,760,609 | 8/1956 | Hagerty | 52/656 |
| 2,878,667 | 3/1959 | Jones . | |
| 2,916,112 | 12/1959 | Keihl | 52/656 |
| 2,993,242 | 7/1961 | Leisibach | 52/304 |
| 2,996,767 | 8/1961 | Kobil et al. . | |
| 3,177,989 | 4/1965 | Chiaro | 49/501 |
| 3,184,801 | 5/1965 | Fletcher . | |
| 3,289,377 | 12/1966 | Hetman | 52/656 |
| 3,349,536 | 10/1967 | Halko, Jr. et al. . | |
| 3,352,060 | 11/1967 | Thams . | |
| 3,750,358 | 8/1973 | Lewkowitz . | |
| 3,769,769 | 11/1973 | Kohl . | |
| 3,861,444 | 1/1975 | Portwood | 49/501 |
| 3,975,881 | 8/1976 | Ninowsky, Jr. | 49/501 |
| 4,010,585 | 3/1977 | Bliven . | |
| 4,407,100 | 10/1983 | Huelsekopf | 49/504 |
| 4,433,517 | 2/1984 | Moore, Jr. . | |
| 4,523,408 | 6/1985 | McConnell | 49/171 |
| 4,569,154 | 2/1986 | Bayer | 49/504 |
| 4,570,406 | 2/1986 | DiFazio | 52/656 |

FOREIGN PATENT DOCUMENTS

| | | | |
|---|---|---|---|
| 2529182 | 1/1977 | Fed. Rep. of Germany | 52/656 |
| 2398168 | 3/1979 | France | 52/656 |

OTHER PUBLICATIONS

Promotional Flyer Entitled "ODL's New Uni-Guard Ventilating Door Light" Published by ODL Incorporated (Copyright 1984).

*Primary Examiner*—Michael Safavi
*Attorney, Agent, or Firm*—Warner, Norcross & Judd

[57] ABSTRACT

The specification discloses a relatively simple and inexpensive ventilated door light or window. The door light includes a one-piece outer frame which supports a fixed glass panel, a screen, and a sliding sash. the door light further includes an inner frame secured to the outer frame to mount the light in a door. Preferably, the inner frame includes two identical L-shaped pieces interlocked to define its rectangular shape.

11 Claims, 4 Drawing Sheets

VENTILATED DOOR LIGHT

BACKGROUND OF THE INVENTION

The present invention relates to windows, and more particularly to windows known as door lights adapted for mounting in doors.

A door light provides a window assembly in a door. Examples of known constructions are illustrated in U.S. Pat. Nos. 3,750,358 issued Aug. 7, 1973 to Lewkowitz, entitled SELF LOCKING DOOR LIGHT MOLDING; U.S. Pat. No. 3,184,801 issued May 25, 1965 to Fletcher, entitled TRIM UNIT FOR FACILITATING THE INSTALLATION OF LIGHTWEIGHT WINDOW UNITS; and U.S. Pat. No. 2,996,767 issued Aug. 22, 1961 to Kobil et al, entitled ADJUSTABLE PANEL MOUNTING SASH. Known constructions are of two basic types--ventilated and fixed. A fixed door light supports only stationary window glass. A ventilated door light includes a movable window sash to selectively permit the passage of air therethrough. For example, the Lewkowitz and Kobil door lights are fixed; while the Fletcher door light is ventilated. Fixed lights are used in relatively cold climates, because these units provide a relatively good weathertight insulative seal within the door. Ventilated lights are used in relatively warm climates where ventilation is frequently desired and the insulation of the unit is not of prime importance.

Known door lights are not without their drawbacks. Most notably, prior constructions are relatively complicated and therefore undesirably expensive. For example, the Fletcher construction includes a multi-piece frame including a plurality of frame segments interconnected by reinforcing corners. Installation of such door lights is relatively labor intensive, because an installer must first construct the frame and then install the constructed frame within the door opening Further, the interconnections between the various frame segments provide areas where the light is not weather tight resulting in air infiltration, decreased insulative value, and decreased resistance to water infiltration.

SUMMARY OF THE INVENTION

The aforementioned problems are overcome in the present invention wherein a ventilated door light is provided having a simple, yet highly efficient and functional, construction. More particularly, the door light includes a one-piece outer frame which supports (1) a fixed glass panel, (2) a screen; and (3) a window sash for sliding movement between closed and opened positions.

The one-piece outer frame, which supports the remaining elements, simplifies manufacture, and subsequent installation, of the door light. The one-piece outer frame also enables an improved weather seal between the frame and the door to reduce air and water infiltration. Third the relatively few pieces in the door light simplify inventory and packaging considerations.

Preferably, an inner frame is also included and secured to the outer frame on opposite sides of a door to support the door light within the door. A tongue-and-groove connection is preferably provided between the inner and outer frames about their entire peripheries to further improve the weather seal of the light within the door.

These and other objects, advantages, and features of the invention will be more fully understood and appreciated by reference to the detailed description of the preferred embodiment and the drawings.

BRIEF DESCRIPTION OF THE DRAWINGS

FIG. 7 is a fragmentary exploded perspective view of an inner frame assembly corner; and FIG. 8 is a fragmentary plan view of the door side of the inner frame assembly.

DETAILED DESCRIPTION OF THE PREFERRED EMBODIMENT

Figure 1:
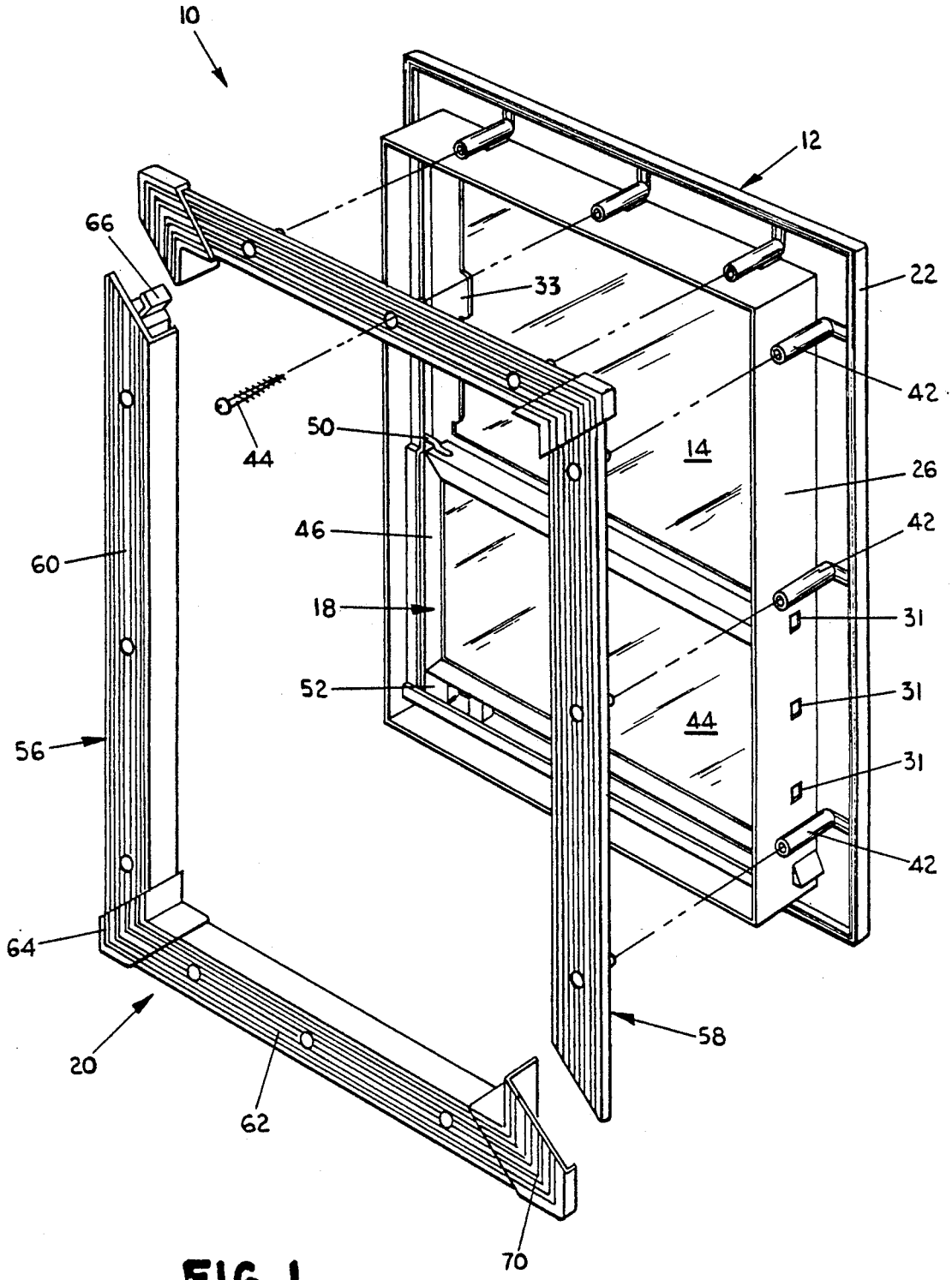
FIG. 1 is a partially exploded perspective view of the door light.
Figure 2:
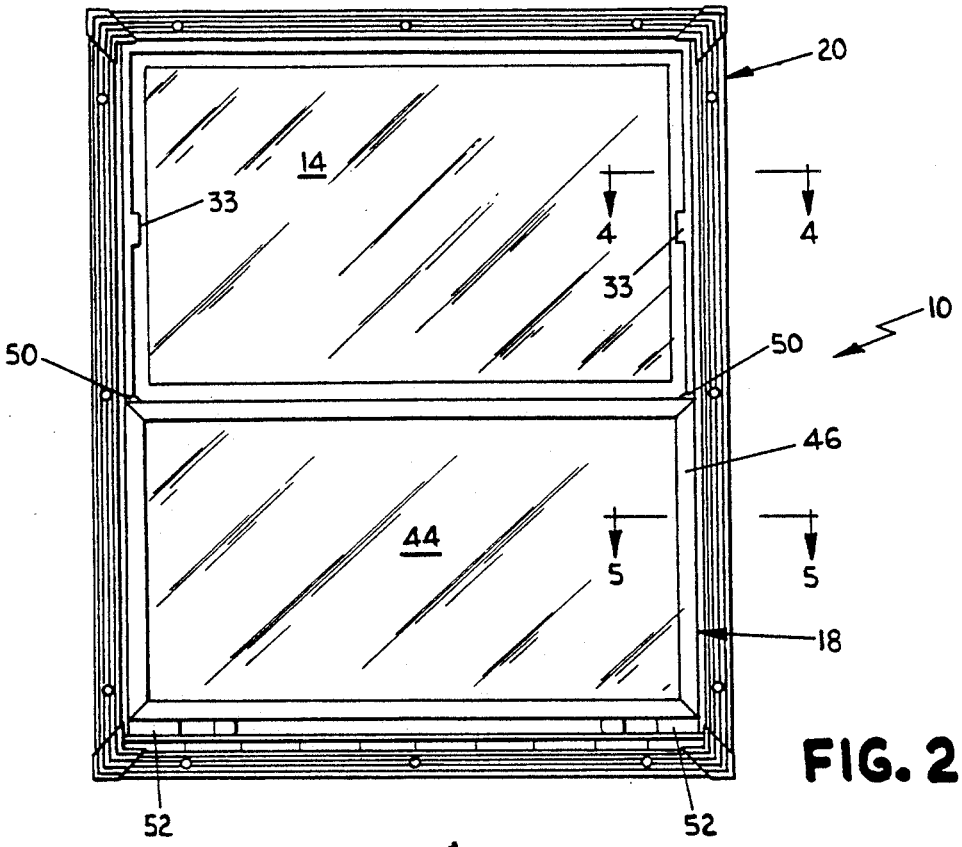
FIG. 2 is an inside elevational view of the door light.
Figure 3:
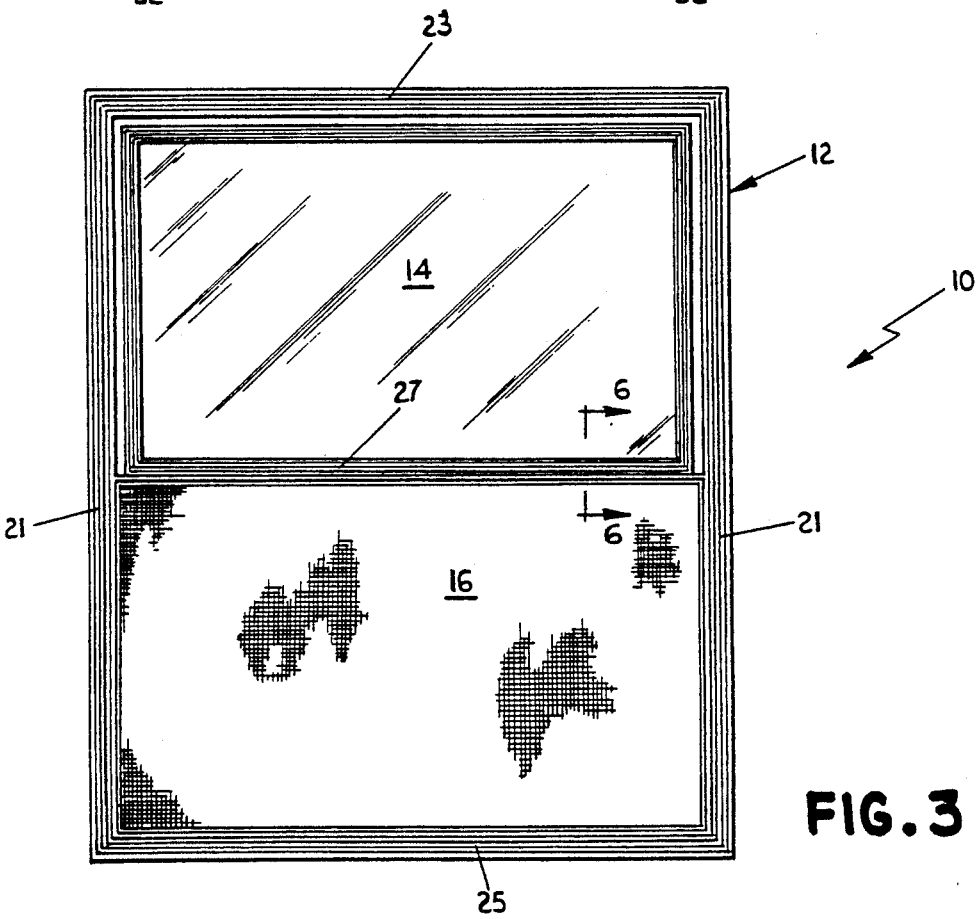
FIG. 3 is an outside elevational view of the door light.

A ventilated door light constructed in accordance with a preferred embodiment of the invention is illustrated in FIGS. 1–3 and generally designated 10. The door light includes an outer frame 12, a fixed glass 14, a screen 16, a sliding sash 18, and an inner frame assembly 20. The outer frame 12 is a one-piece unit supporting the fixed glass 14, the screen 16, and the sash 18. The inner frame assembly 20 is secured to the outer frame 12 to secure the door light 10 within a door (not shown).

The outer frame 12 (FIGS. 1 and 3–6) is a single piece, preferably injection molded of polystyrene. Alternatively, the outer frame 12 can be fabricated of ABS, PVC, or any other injection-moldable plastic. The frame 12 includes two upright portions 21, upper and lower portions 23 and 25, and a cross-piece 27 (FIG. 3). The cross-piece separates the upper and lower frame openings The outer frame 12 includes an outwardly extending lip 22 about the entire periphery of the frame to seal the frame against a door. The exposed surface 24 of the lip 22 is fluted (FIGS. 4 and 5) to enhance the appearance of the outer frame and to provide increased structural rigidity. The frame 12 further includes a tongue 26 extending generally perpendicularly from the lip 22. The tongue also extends about the entire periphery of the frame. Approximately midway along the depth of the tongue 26, a flange 28 extends substantially the full height of the frame 12, which is the full height of the upright portions 21.

Figure 4:
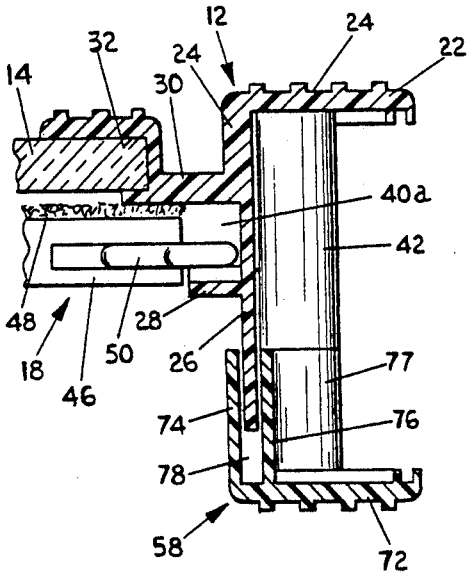
FIG. 4 is a fragmentary sectional view taken along plane 4—4 in FIG. 3.

In the upper portion of the frame 12 (i.e. generally adjacent the fixed panel 14), the frame 12 has the cross section illustrated in FIG. 4. A fixed glass supporting arm 30 extends generally perpendicularly from the tongue 26 approximately midway between the lip 22 and the flange 28. The lip 22 and the flanges 28 and 30 are generally parallel to one another. An upper pin channel 40*a*is defined between the flanges 28 and 30 to accommodate the sash 18 as will be described. The arm 30 defines a channel 32 for fixedly receiving and supporting the edge of the fixed glass panel 14.

Figure 5:
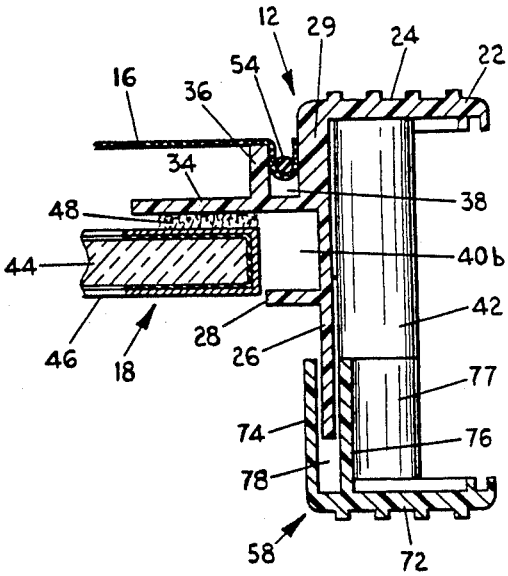
FIG. 5 is a fragmentary sectional view taken along plane 5—5 in FIG. 2.

The frame 12 has a somewhat different cross section in its lower portion (i.e. that area adjacent the screen 16) as illustrated in FIG. 5. A screen flange 34 extends generally perpendicularly from the tongue 26 approximately midway between the lip 22 and the flange 28. A screen spline flange 36 extends generally perpendicularly from the flange 34 to define a screen spline channel 38 between the flange 36 and the thickened portion 29 of the tongue 26. The flanges 28 and 34 together define a lower pin channel or groove **40*b* to accommodate the sash 18 as will be described. A plurality of holes or detents 31 are molded into the lower channel 40*b* (see FIGS. 1 and 6**).

A plurality of mounting bosses 42 extend generally perpendicularly from the lip 22 about the periphery of the outer frame to receive screws 44 (see also FIG. 1) when the assembly is mounted in a door. Preferably, the bosses 42 are also integral with the tongue 26 along at least a portion of their length for reinforcement. The length of the bosses 42 is selected to accommodate the door thickness. Those sizes currently provided accommodate door thicknesses of 1¾ inches and 1⅜ inches.

The fixed glass 14 is supported within the fixed glass channel 32 defined by the arm 30 extending about the periphery of the upper opening. Preferably, a glazing compound (not shown) is utilized to seal the fixed panel 14 within the channel 32. Optionally, the glass panel 14 can be silk-screened (not illustrated) at its border to hide the glazing compound. The fixed panel 14 in the currently preferred embodiment is ⅛ inch single-pane tempered glass. Other transparent, translucent, or even opaque panels could be substituted as desired for aesthetic and/or privacy preferences.

The screen 16 (FIGS. 3 and 5–6) is secured in the lower frame opening. The screen 16 is retained in position by positioning the edge of the screen 16 within the spline channel 38 (see FIG. 5) and forcing the screen spline 54 into the channel to trap the screen therein. Preferably, the screen spline is a single piece extending about the entire periphery of the screen. The preferred screen is fabricated of fiberglass; other materials can be used as desired.

The sash 18 is of generally well known construction and therefore will not be described in detail. As perhaps best illustrated in FIGS. 1 and 2, the sash 18 includes a glass 44 and a surround 46. Preferably, the glass is ⅛ inch single-pane tempered glass; and the surround 46 is fabricated of aluminum with a baked enamel finish. Appropriate glazing is preferably used to mount the glass within the surround As illustrated in FIGS. 4 and 5, a pile weather stripping 48 is permanently attached to the upper horizontal surround member to seal against the frame cross piece 27 when in the fully closed position.

The upper pins 50 and the spring-loaded catches 52 on the sash ride in the pin groove 40 defined by the outer frame 12 (FIGS. 1 and 4). The upper pins 50 are fixedly supported within the surround 46. The catches 52 are spring-loaded into engagement with the outer frame 12 to releasably catch the detents 31 in the channel 40. The detents are positioned to hold the window in the fully open, two-thirds open, one-third open, and fully closed positions. Both lower catches 52 can be fully withdrawn from the pin channels 40 enabling the sash assembly 18 to be removed from the outer frame 12.

Figure 6:
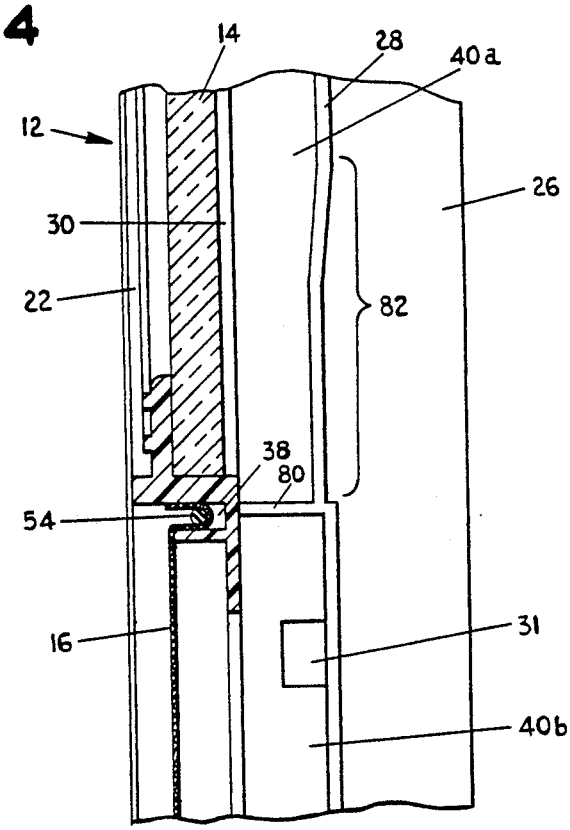
FIG. 6 is a fragmentary partially sectional view taken along plane 6—6 in FIG. 3.

As illustrated in FIG. 6, the upper and lower pin grooves **40*a* and 40*b* are separated by the dividing wall 80, which is integrally formed with the cross member 27. Within the upper pin groove 40*a*, the flange 28 tapers toward the arm 30 in the area 82 immediately above the dividing wall 80 As the sash 18 is lowered or closed, this tapered portion 82 forces the sash pin 50 toward the screen 16 to force the sash 18 and the weather strip 48 against the cross member 27** to provide a tight seal therebetween.

The inner frame assembly 20 includes two inner frame pieces 56 and 58 which are generally identical to one another. Each piece is generally L-shaped and extends about one vertical side 21 and one horizontal side 23 or 25 of the outer frame 12. The inner frame piece 56 includes a vertical leg 60 and a shorter horizontal leg 62 interconnected by a decorative corner 64.

As perhaps best illustrated in FIGS. 4 and 5, the inner frame pieces 56 and 58 each include a lip 72 and a pair of parallel flanges 74 and 76 extending generally perpendicularly therefrom The flanges 74 and 76 define a groove 78 therebetween which receives the tongue 26 of the outer frame 12. This tongue-and-groove construction provides an aesthetically attractive fit between the frame halves and, perhaps more importantly, provides an air break to improve the insulative effect of the assembly 10. The face of the lip 72 is fluted to provide an attractive appearance and to enhance the structural rigidity of the lip 72. A plurality of bosses (FIGS. 4 and 5) extend from the inner frame pieces 56 and 58 to abut the outer frame bosses 42 in the assembled unit.

An L-shaped finger 66 is integrally molded at the free end of the longer leg 60; and a mating stud 68 (see FIG. 7) is integrally molded into the free end of the shorter leg 62. A decorative corner 70 is also integrally molded into the free end of the shorter leg 62 to hide the interconnection of the inner frame pieces 56 and 58. FIGS. 7 and 8 fully illustrate how the finger 66 and stud 68 cooperate to interlock the inner frame pieces together.

ASSEMBLY AND INSTALLATION

Construction of the assembly 10 begins by injection molding the one-piece outer frame 12 and the two inner frame pieces 56 and 58. Preferably, all three pieces are fabricated in a single mold; alternatively, the pieces could be molded in separate molds. The fixed glass 14 is installed by applying sealant or glazing to the upper frame opening and twisting the sides of the outer frame 12 adjacent the upper opening to rotate the tabs 33 away from each other. The upper fixed pane 14 is then positioned in the channel 32 on either side of the outer frame 12; and the outer frame is released so that the sides rotate back to their natural position. The tabs 33 guide and force the fixed pane 14 into position seated within the channel 32.

The screen 16 is next installed by placing the screen 16 over the lower opening in the outer frame 12 with the edge of the screen overlapping the spline channel 38 about the entire perimeter of the screen. The screen spline 54 is force-fitted into the spline channel 38 to entrap the screen edge therein. Any excess screen is trimmed about the spline 54 to provide a neat and attractive appearance.

The sash assembly 18 is purchased by the assignee of the present invention fabricated as illustrated in the drawings. The sash is installed within the outer frame 12 by first fitting the opposite upper pins 50 into the upper pin grooves **40*a*; fully retracting both catches 52; guiding the lower portion of the sash assembly 18 into position; and releasing the catches 52 into the lower pin grooves 40. To ship the unit, the sash assembly 18 is positioned in its fully lowered or closed position with the catches 52** locked within the lower-most detents.

To install the door light 10 within a door, the installer first cuts or otherwise forms an appropriate opening in the door adequate to accommodate the outer frame 12.

In the preferred embodiment, the opening should be one-half inch shorter than the height of the outer frame 12; and one-half inch narrower than the width of the outer frame 12. After the opening is formed, the outer frame 12 is positioned in the opening and the inner frame pieces 56 and 58 are secured to the outer frame from the inside of the door. The finger 66 and stud 68 (FIGS. 7 and 8) on the inner frame pieces 56 and 58 interlock these two pieces. The decorative corners 70 hide the interlocking finger 66 and stud 68 so that all four corners of the inner frame 20 appear to be the same.

Screws 44 are installed through bosses 77 in the inner frame 20 and secured in bosses 42 in the outer frame 12. The screws are tightened until the bosses 77 and 42 abut one another. If the door thickness is proper, the lips 22 and 72 of the outer and inner frames will abut the door. Optionally, caulking or other sealant can be used between the window assembly 10 and the door, especially on the exterior side of the door, to further improve the seal therebetween.

As the inner and outer frames are brought together, the tongue 26 of the outer frame 12 interfits with the groove 78 defined by the inner frame 20 (FIGS. 4 and 5). This provides an air break between the interlocking frames and also provides a finished aesthetically pleasing appearance to the door.

In the present invention, the one-piece outer frame 12 alone supports the fixed panel 14, the screen 16, and the sash assembly 18. This simplifies the construction of the assembly 10 and reduces the cost thereof. The inner frame assembly 20 includes two identical frame pieces 56 and 58 which interlock to provide an aesthetically pleasing appearance. The decorative corners 70 hide the interlocking fingers 66 and studs 68 so that the four corners of the assembly 10 appear to be identical (see FIG. 2).

The above description is that of a preferred embodiment of the invention. Various alterations and changes can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A door light comprising:

a panel;

a screen;

a sash;

a one-piece outer frame to be mounted on a door from an outer side of the door, said outer frame including integral panel channel means for directly receiving and fixedly supporting said panel, integral screen spline channel means for directly receiving and supporting said screen, and integral sash channel means for directly receiving and supporting said sash for movement between a closed position substantially covering said screen and an open position wherein said screen is at least partially uncovered, said panel channel means and said screen spline channel means being generally coplanar with each other such that said panel and said screen are in general alignment with one another, said panel channel means, said screen spline channel means, and said sash channel means being unitary portions of said one-piece outer frame;

an inner frame to be mounted on the door from an inner side of the door opposite the outer frame; and securing mean for securing the outer and inner frames together to support said door light within the door.

2. A door light as defined in claim 1 wherein said outer and inner frames are both rectangular, and further wherein said inner frame includes two generally identical L-shaped frame pieces arranged to define an rectangle, said frame pieces including interlocking means for interlocking the free ends of said frame pieces at two corners of said rectangular inner frame, said frame pieces further including cover means for covering said interlocking means in the assembled door light so that the four corners of said rectangular inner frame appear to be generally identical.

3. A door light as defined in claim 1 wherein said one-piece outer frame is injection molded.

4. A door light as described in claim 2 wherein said one-piece outer frame is injection molded and each of said frame pieces is a single injection-molded piece.

5. A door light as defined in claim 1 in which said sash channel means further includes an upper portion adjacent said panel channel means and a lower portion adjacent said screen spline channel means, wherein said upper portion of said sash channel means includes a tapered portion which shifts said sash toward said screen when said sash is moved to a closed position adjacent said screen, whereby a tight sealing arrangement is obtained when the sash is closed.

6. A door light as defined in claim 1 in which said screen spline channel means opens outwardly in a direction generally orthogonal to a plane defined by said screen spline channel.

7. A window comprising:

a one-piece first frame to be mounted in a supporting structure, said first frame defining upper and lower openings, said first frame defining a panel channel extending only about said upper opening, a screen spline channel extending only about said lower opening, and a pair of opposite sash channels opening toward one another from opposite sides of said first frame; said panel channel, said screen spline channel, and said sash channels all being unitary with said first frame;

a transparent panel directly fixedly supported by said one-piece first frame within said upper opening and fitted within said panel channel;

a screen directly fixedly supported by said one-piece first frame within said lower opening, said screen having a peripheral portion fitted within said screen spline channel;

a sash directly supported by said one-piece first frame and including portions fitted within said sash channels for sliding movement between said upper and lower openings;

a second frame to be mounted in the supporting structure opposite said first frame; and securing means for securing the first and second frames together.

8. A window as defined in claim 7 wherein said second frame includes two generally identical L-shaped frame pieces arranged to form a rectangle, said frame pieces including interlocking means for interlocking the free ends of said frame pieces at two corners of said second frame, said frame pieces further including cover means for covering said interlocking means so that the four corners of said second frame appear to be generally identical.

9. A window as defined in claim 7 in which said screen spline channel opens outwardly in a direction generally orthogonal to a plane defined by said screen spline channel.

10. A window comprising:

a one-piece frame including a pair of side frame members each having an integral panel channel opening toward the panel channel of the other side frame member, said panel channels being for directly receiving and fixedly supporting a panel, each side frame member further having an integral sash channel opening toward the sash channel of the other side frame member, said sash channels being for directly receiving and slidably supporting a sash, said panel channels and said sash channels being a unitary part of the respective side frame members, said frame including an integral screen spline channel for receiving and supporting a screen, said screen spline channel being a unitary part of said frame and opening outwardly in a direction generally orthogonal to a plane defined by said screen spline channel, said panel channels being substantially coplanar with said screen spline channel, and said sash channel being adjacent said panel channel along a portion of its length and adjacent said screen spline channel along another portion of its length;

a panel directly received within and fixedly supported by said panel channels;

a sash directly received within and slidably supported by said sash channels for movement between a closed position and an open position; and a screen having a portion fitted within said screen spline channel and positioned in substantial alignment with said panel.

11. A window as defined in claim 10 further comprising:

a second frame including a pair of generally identical L-shaped frame pieces arranged to define a rectangle, said frame pieces including interlocking means for interlocking the free ends of said frame pieces at two corners of said second frame, said frame pieces further including cover means for covering said interlocking means so that the four corners of said second frame appear to be generally identical; and securing means for intersecuring said first and second frames to entrap a supporting member therebetween to support said window within the member.

* * * * *

UNITED STATES PATENT AND TRADEMARK OFFICE

CERTIFICATE OF CORRECTION

PATENT NO. : 4,989,381

DATED : February 5, 1991

INVENTOR(S) : David A. DeBlock et al

It is certified that error appears in the above-identified patent and that said Letters Patent is hereby corrected as shown below:

In the Abstract:
Line 4
Delete "the" and insert --The--

Column 6, Claim 2, line 8
Delete "an" and insert --a--

Signed and Sealed this

Twenty-fourth Day of November, 1992

*Attest:*

DOUGLAS B. COMER

*Attesting Officer*

*Acting Commissioner of Patents and Trademarks*